US006771217B1

(12) United States Patent
Liu et al.

(10) Patent No.: US 6,771,217 B1
(45) Date of Patent: Aug. 3, 2004

(54) PHASED ARRAY POINTING DETERMINATION USING INVERSE PSEUDO-BEACON

(75) Inventors: Ketao Liu, Cerritos, CA (US); Paul C. Werntz, Long Beach, CA (US)

(73) Assignee: The Boeing Company, Chicago, IL (US)

( * ) Notice: Subject to any disclaimer, the term of this patent is extended or adjusted under 35 U.S.C. 154(b) by 4 days.

(21) Appl. No.: 10/371,141

(22) Filed: Feb. 20, 2003

(51) Int. Cl.[7] ..... H01Q 3/22; H01Q 3/24; H01Q 3/26

(52) U.S. Cl. ..... 342/368; 342/173; 342/465; 342/442

(58) Field of Search ..... 342/360, 359, 342/173, 174, 465, 442, 368

(56) References Cited

U.S. PATENT DOCUMENTS 5,347,286 A * 9/1994 Babitch ..... 342/359

* cited by examiner

*Primary Examiner*—Theodore M. Blum

(74) *Attorney, Agent, or Firm*—Gates & Cooper LLP

(57) ABSTRACT

A method and apparatus for determining and correcting for phased array mispointing errors, particularly those due to structural deformation, is disclosed. The method comprises the steps of receiving a signal from each of a plurality of signal sources at at least one receiving sensor disposed away from the phased array in a direction at least partially toward a receiver of a transmitted signal from the phased array, and determining the phased array pointing from the received signals. The apparatus comprises a receiving sensor for receiving a signal from each of a plurality of signal sources, the receiving sensor disposed away from the phased array in a direction at least partially toward a receiver of a transmitted signal from the phased array, and an array pointing computer for determining the direction of the phased array from the received signals.

36 Claims, 9 Drawing Sheets

PHASED ARRAY POINTING DETERMINATION USING INVERSE PSEUDO-BEACON

BACKGROUND OF THE INVENTION

1. Field of the Invention

The present invention relates in general to methods of directing spacecraft payloads and in particular to a method and apparatus for determining and correcting for the pointing error of a phased array antenna on a spacecraft.

2. Description of the Related Art

Satellite systems are widely used to transmit information to many ground users. In satellite-based communication, it is desirable to transmit information to ground-based users in certain areas, but not the ground-based users in other areas. This is accomplished with the use of "spot beams" that concentrate the energy of the transmitted signal to a limited terrestrial area. To assure optimum reception by all ground-based users, to prevent interference among users in different areas, and to reduce the probability of unauthorized reception at ground stations not authorized to receive the transmitted spot beam, it is important that the spot beam be accurately directed to the proper terrestrial locations. Deviation of antenna pointing typically causes a drop of signal power for communications to and from the spacecraft and ground user in the satellite's services areas, thus degrading the communications services provided by the satellite.

Antenna pointing is usually controlled by a control system so that antenna communication beams will be accurately directed to the proper target(s).

Spot beam pointing accuracy can be limited by many factors. One of these factors is deformation of the structures supporting the phased array antenna on the spacecraft bus/body. Such errors can result from thermal gradients, launch environment effects, or other factors. Further, because sensors that are used to determine spacecraft pointing are usually placed at locations remote from the transmitting or receiving antennas and the components subject to structural deformation, such errors are typically unobservable by these sensors.

One technique for ameliorating this problem is to use an attitude sensor such as a star tracker, Earth sensor, or beacon sensor very close to or on the communication antenna itself. Unfortunately, this approach cannot be economically applied to satellites that have multiple communication antennas. Also, the use of beacon sensors can be unacceptably expensive because a terrestrial beacon station must be maintained for the on-board beacon sensor. This is especially the case for non-geosynchronous satellites because a single terrestrial beacon station will not be able to cover the entire orbit of the satellite and many stations are usually needed. What is needed is a system and method for compensating for these errors. The present invention satisfies that need.

SUMMARY OF THE INVENTION

To address the requirements described above, the present invention discloses a method and apparatus for determining pointing of a phased array. The method comprises the steps of receiving a signal from each of a plurality of signal sources at at least one receiving sensor disposed away from the phased array in a direction at least partially toward a receiver of a transmitted signal from the phased array, and determining the phased array pointing from the received signals. The apparatus comprises a receiving sensor for receiving a signal from each of a plurality of signal sources, the receiving sensor disposed away from the phased array in a direction at least partially toward a receiver of a transmitted signal from the phased array, and an array pointing computer for determining the direction of the phased array from the received signals.

BRIEF DESCRIPTION OF THE DRAWINGS

Referring now to the drawings in which like reference numbers represent corresponding parts throughout.

DETAILED DESCRIPTION OF PREFERRED EMBODIMENTS

In the following description, reference is made to the accompanying drawings which form a part hereof, and which is shown, by way of illustration, several embodiments of the present invention. It is understood that other embodiments may be utilized and structural changes may be made without departing from the scope of the present invention.

Figure 1:
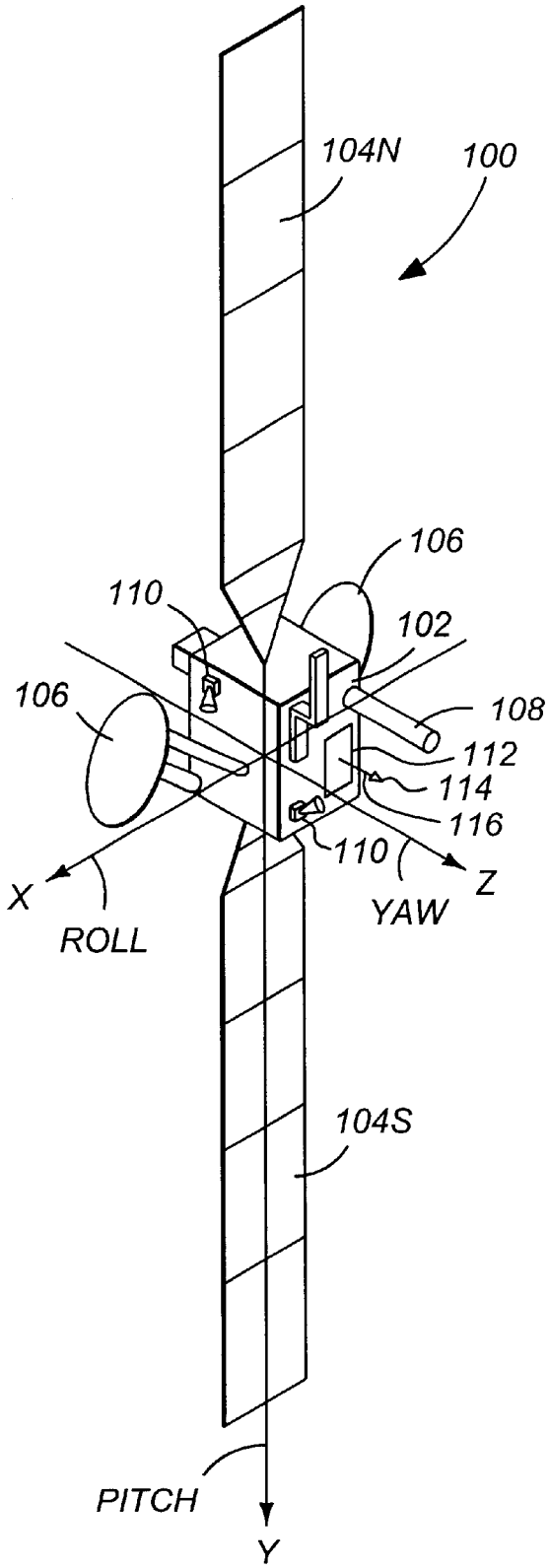
FIG. 1 is a diagram illustrating a satellite or spacecraft.

FIG. 1 illustrates a three-axis stabilized satellite or spacecraft 100. The spacecraft 100 is either situated in a stationary (geostationary or geosynchronous) orbit about the Earth, or in a mid-Earth (MEO) or low-Earth (LEO) orbit. The satellite 100 has a main body or spacecraft bus 102, a pair of solar panels 104, a pair of high gain narrow beam antennas 106, and a telemetry and command omni-directional antenna 108 which is aimed at a control ground station. The satellite 100 may also include one or more sensors 110 to measure the attitude of the satellite 100. These sensors may include sun sensors, earth sensors, and star sensors. Since the solar panels are often referred to by the designations "North" and "South", the solar panels in FIG. 1 are referred to by the numerals 104N and 104S for the "North" and "South" solar panels, respectively.

The three axes of the spacecraft 100 are shown in FIG. 1. The pitch axis P lies along the plane of the solar panels 140N and 140S. The roll axis R and yaw axis Y are perpendicular to the pitch axis P and lie in the directions and planes shown. The antenna 108 points to the Earth along the yaw axis Y.

The spacecraft 100 includes a phased array antenna 112 mounted on the spacecraft bus 102 or a supporting structure. The phased array antenna 112 can be used to transmit signals with wide angle or spot beams as desired. The spacecraft 100 also includes a boom 116 or other appendage, having a receiving sensor 114 such as a receiving horn mounted on the boom so that it's sensitive axis is directed substantially at the planar array. The boom-mounted calibration sensor sometimes used with phased array antennas can be used as the receiving horn 114 and boom, thus allowing the calibration system to be used to perform on-orbit pointing correction. As will be discussed in greater detail below, the boom 116 and receiving horn 114 permit the phased array pointing error to be accurately determined and compensated for.

Figure 2:
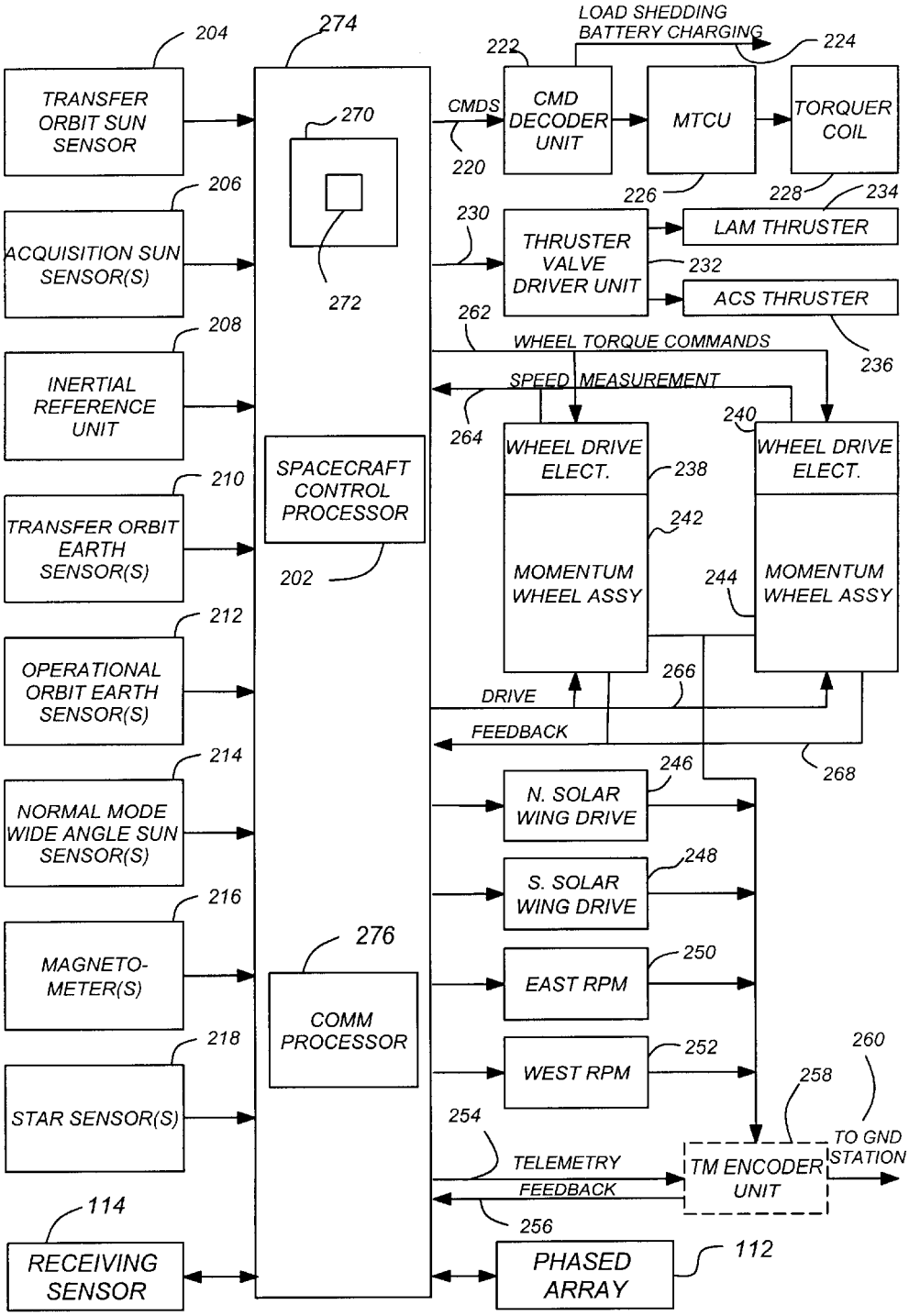
FIG. 2 is a diagram depicting the functional architecture of a representative spacecraft control system.

FIG. 2 is a diagram depicting the functional architecture of a representative attitude control system. The spacecraft 100 includes a processor subsystem 274, which includes a spacecraft control processor (SCP) 202 and a communication processor (CP) 276.

The SCP 202 implements control of the spacecraft 100. The SCP performs a number of functions which may include post ejection sequencing, transfer orbit processing, acquisition control, stationkeeping control, normal mode control, mechanisms control, fault protection, and spacecraft systems support, among others. The post ejection sequencing could include initializing to assent mode and thruster active nutation control (TANC). The transfer orbit processing could include attitude data processing, thruster pulse firing, perigee assist maneuvers, and liquid apogee motor (LAM) thruster firing. The acquisition control could include idle mode sequencing, sun search/acquisition, and Earth search/acquisition. The stationkeeping control could include auto mode sequencing, gyro calibration, stationkeeping attitude control and transition to normal. The normal mode control could include attitude estimation, attitude and solar array steering, momentum bias control, magnetic torquing, and thruster momentum dumping (H-dumping). The mechanisms mode control could include solar panel control and reflector positioning control. The spacecraft control systems support could include tracking and command processing, battery charge management and pressure transducer processing.

Input to the spacecraft control processor 202 may come from any combination of a number of spacecraft components and subsystems, such as a transfer orbit sun sensor 204, an acquisition sun sensor 206, an inertial reference unit 208, a transfer orbit Earth sensor 210, an operational orbit Earth sensor 212, a normal mode wide angle sun sensor 214, a magnetometer 216, and one or more star sensors 218.

The SCP 202 generates control signal commands 220 which are directed to a command decoder unit 222. The command decoder unit operates the load shedding and battery charging systems 224. The command decoder unit also sends signals to the magnetic torque control unit (MTCU) 226 and the torque coil 228.

The SCP 202 also sends control commands 230 to the thruster valve driver unit 232 which in turn controls the liquid apogee motor (LAM) thrusters 234 and the attitude control thrusters 236.

Wheel torque commands 262 are generated by the SCP 202 and are communicated to the wheel speed electronics 238 and 240. These effect changes in the wheel speeds for wheels in momentum wheel assemblies 242 and 244, respectively. The speed of the wheels is also measured and fed back to the SCP 202 by feedback control signal 264.

The spacecraft control processor also sends jackscrew drive signals 266 to the momentum wheel assemblies 243 and 244. These signals control the operation of the jackscrews individually and thus the amount of tilt of the momentum wheels. The position of the jackscrews is then fed back through command signal 268 to the spacecraft control processor. The signals 268 are also sent to the telemetry encoder unit 258 and in turn to the ground station 260.

The SCP 202 communicates with the telemetry encoder unit 258, which receives the signals from various spacecraft components and subsystems indicating current operating conditions, and then relays them to the ground station 260. The telemetry encoder unit 258 also sends ground commands to the SCP 202 that executes various ground command spacecraft maneuvers and operations.

The wheel drive electronics 238, 240 receive signals from the SCP 202 and control the rotational speed of the momentum wheels. The jackscrew drive signals 266 adjust the orientation of the angular momentum vector of the momentum wheels. This accommodates varying degrees of attitude steering agility and accommodates movement of the spacecraft as required.

The use of reaction wheels or equivalent internal torquers to control a 3-axes stabilized spacecraft allows inversion about yaw of the attitude at will. In this sense, the canting of the momentum wheel is entirely equivalent to the use of reaction wheels. Other spacecraft employ external torquers, chemical or electric thrusters, magnetic torquers, solar pressure, etc. to control spacecraft attitude.

The CP 276 and SCP 202 may include or have access to one or more memories 270, including, for example, a random access memory (RAM). Generally, the CP and SCP 202 operates under control of an operating system 272 stored in the memory 270, and interfaces with the other system components to accept inputs and generate outputs, including commands. Applications running in the CP 276 and SCP 202 access and manipulate data stored in the memory 270. The spacecraft 100 may also comprise an external communication device such as a satellite link for communicating with other computers at, for example, a ground station. If necessary, operation instructions for new applications can be uploaded from ground stations. The CP 276 and SCP 202 can also be implemented in a single processor, or with different processors having separate memories.

In one embodiment, instructions implementing the operating system 272, application programs, and other modules are tangibly embodied in a computer-readable medium, e.g., data storage device, which could include a RAM, EEPROM, or other memory device. Further, the operating system 272 and the computer program are comprised of instructions which, when read and executed by the SCP 202, causes the spacecraft processor 202 to perform the steps necessary to implement and/or use the present invention. Computer program and/or operating instructions may also be tangibly embodied in memory 270 and/or data communications devices (e.g. other devices in the spacecraft 10 or on the ground), thereby making a computer program product or article of manufacture according to the invention. As such, the terms "program storage device," "article of manufacture" and "computer program product" as used herein are intended to encompass a computer program accessible from any computer readable device or media.

Figure 3A:
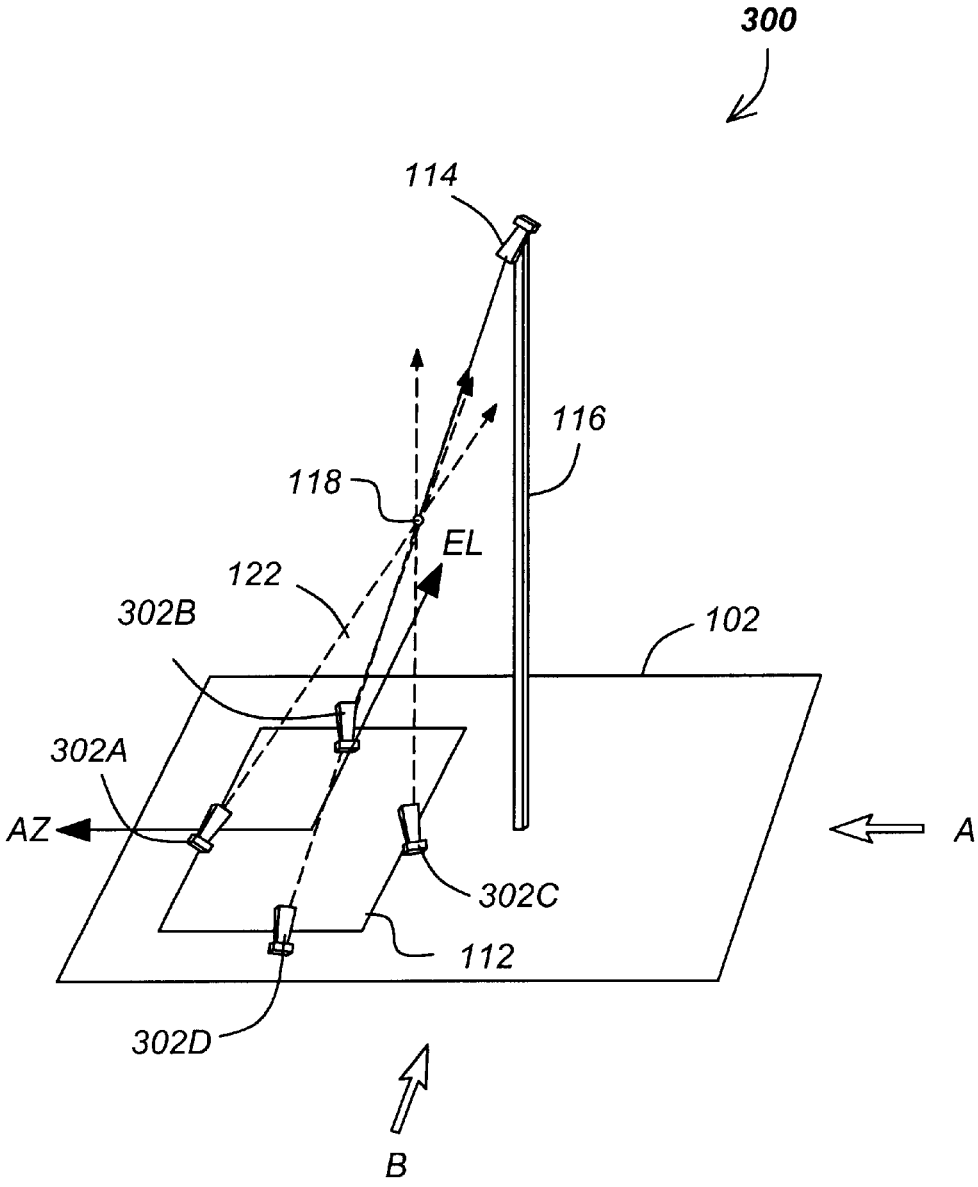
FIGS. 3A–3C are diagrams depicting elements of a phased array pointing determination and correction device.

FIG. 3A is a diagram showing elements of the phased array pointing device 300. The phased array pointing device 300 comprises a boom or appendage 116 extending from the spacecraft bus 102. A receiving sensor 114 such as a radio frequency (RF) horn is attached to the boom 116 at the end of the boom 116 opposite the boom's attachment to the spacecraft bus 102. The receiving sensor 114 is disposed away from the phased array 112 on the surface of the spacecraft bus 102, and in a direction at least partially toward a receiver of a signal transmitted from the phased array 112 (in a direction away from the spacecraft bus 102).

The phased array pointing device 300 also includes a plurality of signal sources 302A–302D (hereinafter alternatively referred to as signal source(s) 302. Although four signal sources 302 are shown (up signal source 302A, down signal source 302C, left signal source 302D and right signal source 302B), the present invention can be implemented with a fewer or greater number of signal sources 302. In the illustrated embodiment, the signal sources 302 are RF horns disposed about the periphery and at the center of each side of the phased array 112, and together span a two-dimensional plane coincident with the phased array 112.

In the illustrated embodiment, the signal sources 302 form four transmitting beams that form a directional pyramid 122. The transmitted beams are received by the receiving sensor 114 along a null vector 120 a short distance away.

The four signal sources 302 have the location, line of sight separations, and beam widths described in Table 1 below:

TABLE 1

| | LOS Angular Separation from Beacon Null Vector 122 | Beamwidth | Location Separation from Beacon Null Vector 122 |
|---|---|---|---|
| Up Signal Source 302A | $\phi_{EL}$ | $\psi$ | $d_{AZ}$ |
| Down Signal Source 302C | $-\phi_{EL}$ | $\psi$ | $-d_{AZ}$ |
| Left Signal Source 302D | $\phi_{AZ}$ | $\psi$ | $p_{EL}$ |
| Right Signal Source 302B | $-\phi_{AZ}$ | $\psi$ | $-p_{EL}$ |

Figure 3B:
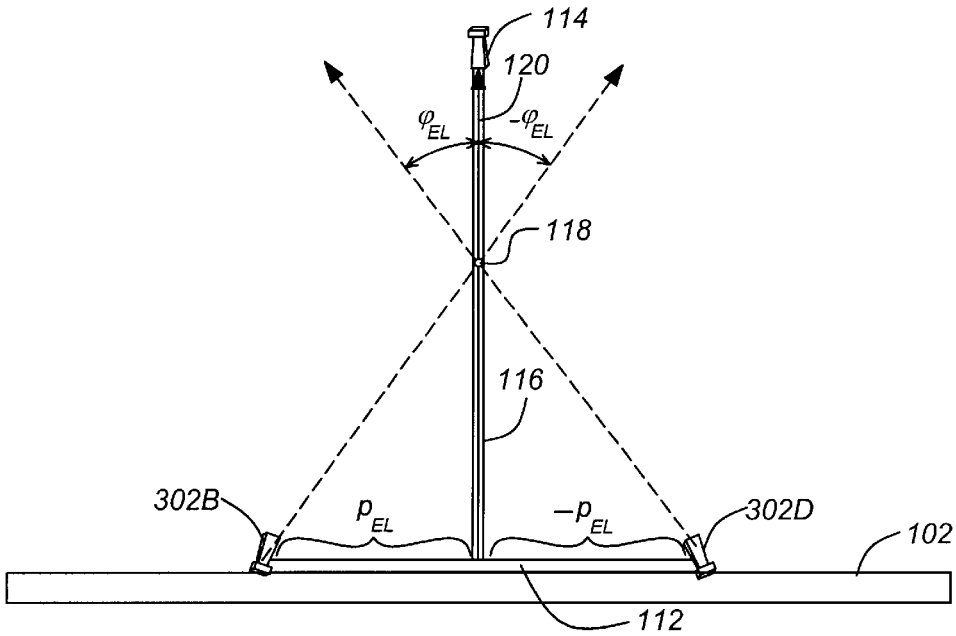
Figure 3C:
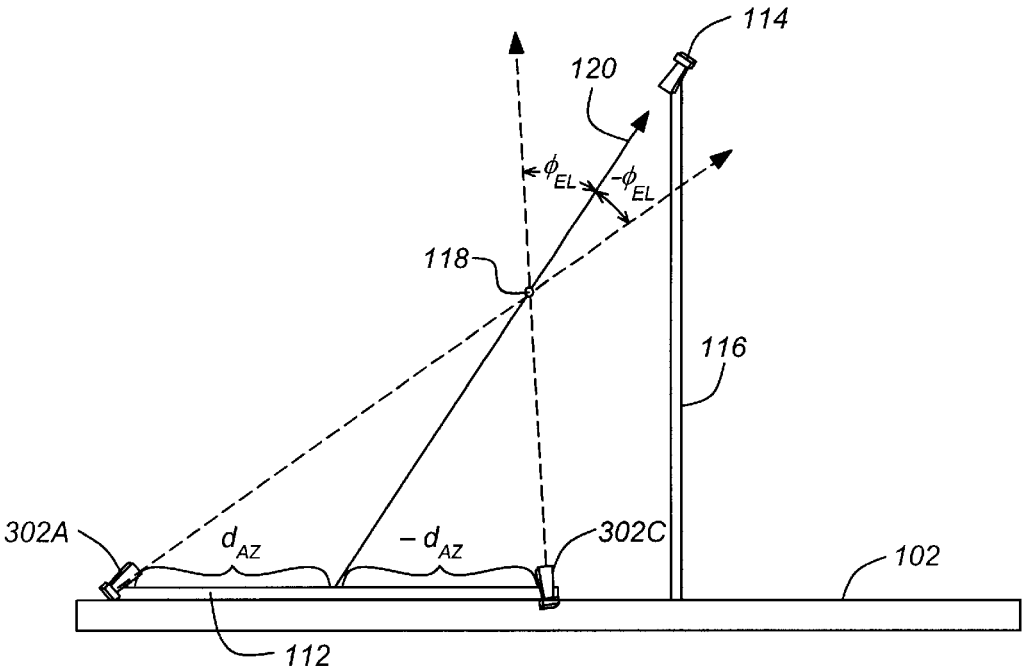

FIGS. 3B and 3C are diagrams showing selected elements of the phased array pointing determination and correction device 300 from perspective "A" shown in FIG. 3A, and FIG. 3C is a diagram showing elements of the phased array pointing device 300 from perspective "B" shown in FIG. 3A.

Figure 4:
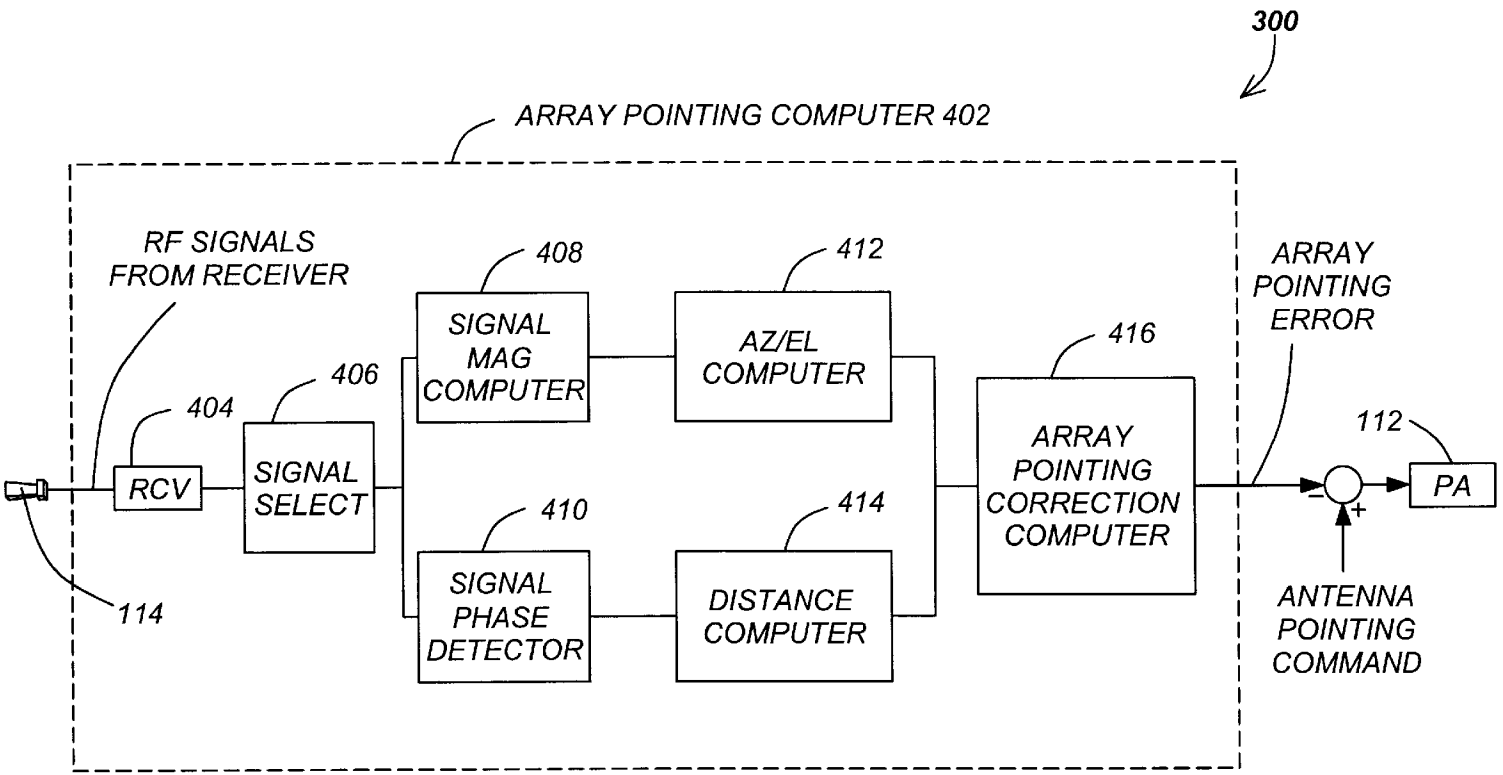
FIG. 4 is a diagram illustrating one implementation of the phased array pointing determination and correction device.

FIG. 4 is a diagram illustrating an embodiment of further elements of the phased array pointing device 300. The array pointing device 300 includes an array pointing computer 402 communicatively coupled to the receiving sensor 114 and the phased array 112. The receiving sensor 114 is communicatively coupled to a receiver 402, which detects and demodulates the signals sensed by the receiving sensor 114. The received signals are provided to a signal selector 406, which separates the signals received from each of the signal sources 302, so that the signal from each can be appropriately analyzed. As each signal may be distinguishable from the others by transmitting one at a time, or at different frequencies, or with different codes, the functionality of the signal selector 406 may be intermingled with that of the receiver 404. The output of the signal selector 404 is provided to a signal magnitude computer 408 which determines the magnitude of the signals received at the receiving sensor 114, and a phase detector 410, which determines the phase of each of the receiving signals. The phase information is provided to a distance computer 414, which computes a distance between each of the signal sources 302 and the receiving sensor 114. The output of the signal magnitude computer 408 is provided to the deviation angle computer 412. The output of the deviation angle computer 412 and distance computer 414 are provided to an array pointing correction computer 416, which generates a phased array pointing error. The pointing error is combined with the phased array pointing command to compensate for the computed errors, and provided to the phased array 112.

Figure 5A:
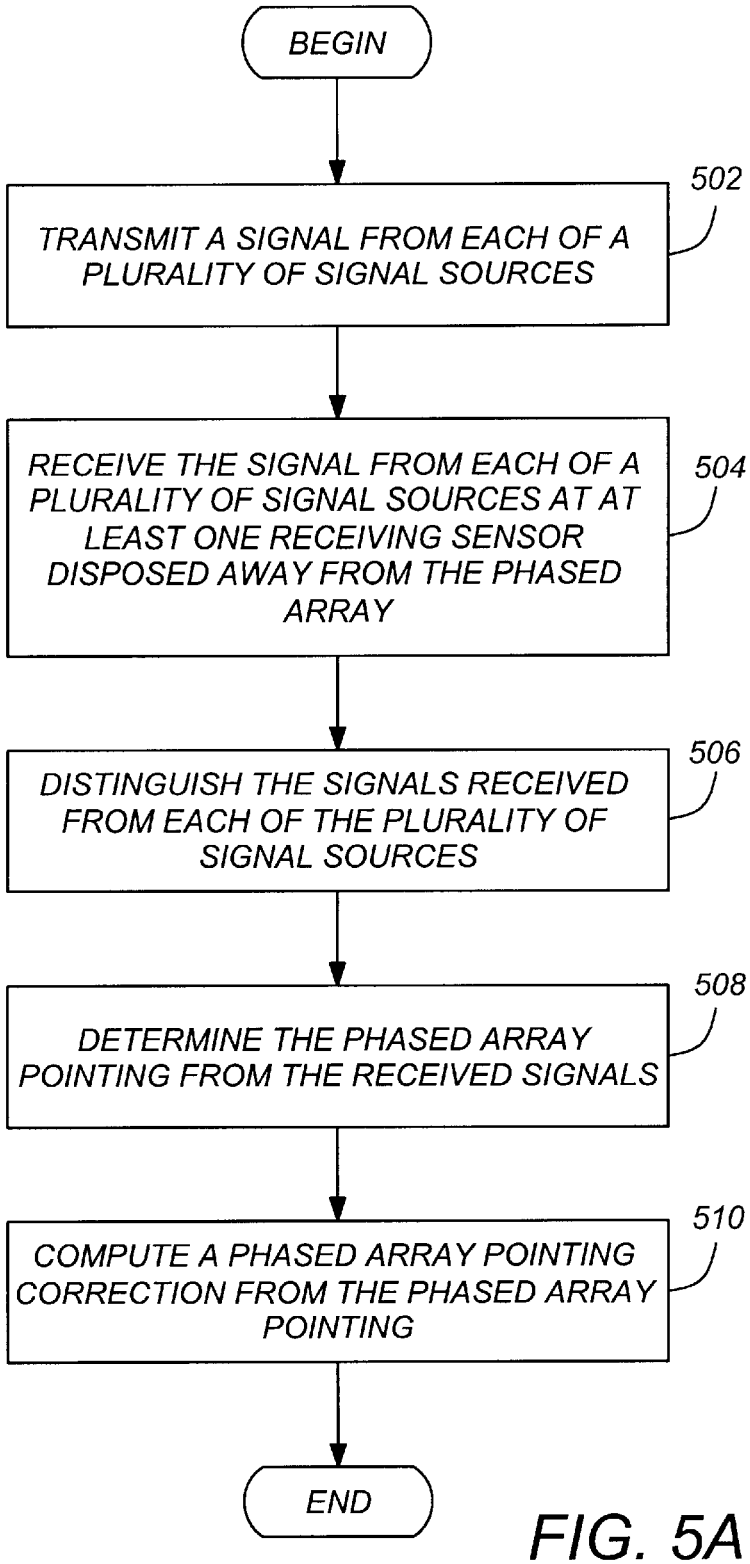
FIGS. 5A and 5B are flow charts illustrating exemplary process steps that can be used to practice the present invention.
Figure 5B:
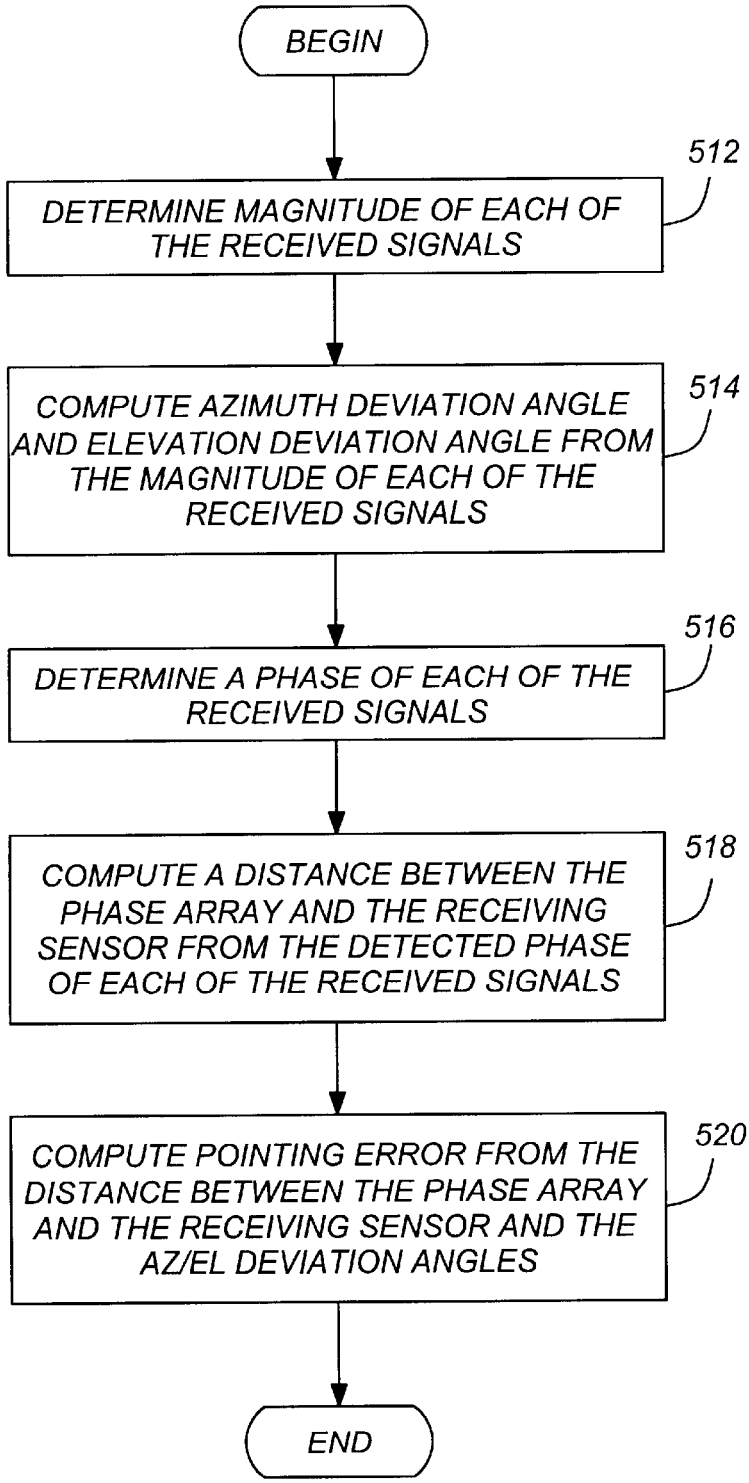

FIGS. 5A and 5B are flow charts illustrating exemplary process steps that can be used to practice the present invention. Referring first to FIG. 5A, a plurality of signals are transmitted from the signal sources 302 in the direction of the receiving horn 114, as shown in block 502. In one embodiment, the boresight of the horns used to transmit the plurality of signals are directed away from the receiving horn 114 and cross each other between the signal sources 302 and the receiving horn 114 at focus point 118.

The plurality of signals are received by the receiving horn 114 and the receiver 404, as shown in block 504. In the illustrated embodiment, the receiving horn 114 is disposed away from the phased array 112 in the direction that the phased array 112 ordinarily transmits signals. This is shown in block 504. The received signals are then distinguished from one another, either by the time that they were received, the modulation frequency of the transmitted signal or by a signal code. This is shown in block 506, and in the embodiment illustrated in FIG. 4, this is performed by the signal selector 406. The phased array pointing (either the error between the indicated direction and the measured direction or the actual pointing direction) is determined from the received signals, as shown in bock 508, and a phased array pointing correction is computed from the phased array pointing, as shown in block 510.

FIG. 5B is a flow chart describing exemplary process steps that can be used to determine the phased array pointing from the received signals. In block 512, a magnitude of each of the received signals is determined. In the embodiment illustrated in FIGS. 3A–3C, there are four signal sources, including an up signal source 302A, a down signal source 302C, a left signal source 302D, and a right signal source 302B.

Next, an azimuth and elevation deviation angle is computed from the magnitude of each of the received signals, as shown in block 514. This can be accomplished as according to equation (1) below.

$$EL_{meas} = \alpha\frac{Mag_{up} - Mag_{down}}{Mag_{up} + Mag_{down}}, \qquad \text{Equation (1)}$$

$$AZ_{meas} = \beta\frac{Mag_{left} - Mag_{right}}{Mag_{left} + Mag_{right}}$$

wherein $Mag_{up}$ is a magnitude of the received signal from the up signal source 302A, $Mag_{down}$ is a magnitude of the received signal from the down signal source 302C, $Mag_{left}$ is a magnitude of the received signal from the left signal source 302D, $Mag_{right}$ is a magnitude of the received signal from the right signal source 302B, $\alpha$ is a first scale factor, and $\beta$ is a second scale factor.

The phase of each of the received signals is also computed, as shown in block 516. A distance is computed between the signal sources 302 and the receiving horn 114, as shown in block 518. This can be accomplished according to equations (2a)–(2d) below:

$$D_{up} = \frac{phase_{up}}{2\pi}\lambda_{up} \qquad \text{Equation (2a)}$$

$$D_{down} = \frac{phase_{down}}{2\pi}\lambda_{down} \qquad \text{Equation (2b)}$$

$$D_{left} = \frac{phase_{left}}{2\pi}\lambda_{left} \qquad \text{Equation (2c)}$$

$$D_{right} = \frac{phase_{right}}{2\pi}\lambda_{right} \qquad \text{Equation (2d)}$$

wherein $D_{up}$, $D_{down}$, $D_{left,\ and\ Dright}$ are measured distances from the up, down, left, and right signal sources (302A, 302C, 302D and 302B) to the receiving sensor, respectively, and $\lambda$ is wavelength of the radio frequency (RF) signal.

Next, as shown in block 520, a pointing error of the phased array 112 is determined from the distance between the signal sources 302 and the receiving horn, and the azimuth and elevation deviation angles. This can be accomplished a variety of ways. For the four signal source embodiment disclosed in FIGS. 3A–3C this can be accomplished as follows:

$$\begin{bmatrix} \Delta\theta_{\text{array_x}} \\ \Delta\theta_{\text{array_y}} \end{bmatrix} = I_{xy}(\nabla M^T \nabla M)^{-1} \nabla M^T * \begin{bmatrix} \Delta EL \\ \Delta AZ \\ \Delta D_{up} \\ \Delta D_{down} \\ \Delta D_{left} \\ \Delta D_{right} \end{bmatrix}, \quad \text{Equation (3)}$$

$$I_{xy} = \begin{bmatrix} 1 & 0 & 0 & 0 & 0 & 0 \\ 0 & 1 & 0 & 0 & 0 & 0 \end{bmatrix}$$

wherein the array pointing error is $\alpha\theta_{array_x}$ is the angular error in one direction and $\Delta\theta_{array_y}$ is the angular error in a direction orthogonal from the first angular error ΔEL and ΔAZ are the difference between the elevation and azimuth deviation angles $EL_{meas}$ and $AZ_{meas}$ described above and the nominal pointing angle ($\Delta EL = EL_{meas} - EL_0$, and $\Delta AZ = AZ_{meas} - AZ_0$), $\Delta D_{up}$, $\Delta D_{down}$, $\Delta D_{left}$, and $\Delta D_{right}$ describe the difference between the distances from each of the signal sources and the receiving horn 114 $D_{up}$, $D_{down}$, $D_{left}$, and $D_{right}$ and the nominal (measured distance, not accounting for spacecraft bus deformation, e.g. $\Delta D_{up} = D_{up} - D_{up_0}$, $\Delta D_{down} = D_{down} - D_{down_0}$, $\Delta D_{left} = D_{left} - D_{left_0}$, and $\Delta D_{right} = D_{right} - D_{right_0}$).

The gradient ∇M is computed from a sensitivity matrix ∇F as described below.

$$\nabla F = \begin{bmatrix} I_{EL} & T_{\text{center_receive_EL}} \\ I_{AZ} & T_{\text{center_receive_AZ}} \\ v_{\text{up_receive}} S_{\text{up_center}} & v_{\text{up_receive}} \\ v_{\text{down_receive}} S_{\text{down_center}} & v_{\text{down_receive}} \\ v_{\text{left_receive}} S_{\text{left_center}} & v_{\text{left_receive}} \\ v_{\text{right_receive}} S_{\text{right_center}} & v_{\text{right_receive}} \end{bmatrix} \quad \text{Equation (3)}$$

$$\begin{bmatrix} C_{\text{Null_SC}} & 0 \\ 0 & C_{\text{Null_SC}} \end{bmatrix}$$

wherein $$I_{EL} = [100],\ I_{AZ} = [010],$$

$C_{Null_SC}$ is a direction matrix describing a transformation from a spacecraft body reference frame to a null vector 120 (extending from the center of the phase array 112 to the receiving horn 114) reference frame;

$S_{up_center}$ is a skew symmetric position vector matrix describing a vector from the center of the phase array 112 to the up signal source 302A;

$S_{down_center}$ is a skew symmetric position vector matrix describing a vector from the center of the phase array 112 to the down signal source 302C;

$S_{left_center}$ is a skew symmetric position vector matrix describing a vector from the center of the phase array 112 to the left signal source 302D;

$S_{right_center}$ is a skew symmetric position vector matrix describing a vector from the center of the phase array 112 to the right signal source 302B.

$$T_{\text{center_receive_EL}} = \begin{bmatrix} 0 & \frac{1}{d_{\text{center_receive}}} & 0 \end{bmatrix}, \quad \text{Equation (4)}$$

$$T_{\text{center_receive_AZ}} = \begin{bmatrix} \frac{1}{d_{\text{center_receive}}} & 0 & 0 \end{bmatrix}, \text{ and} \quad \text{Equation (5)}$$

$$v_i = \frac{\lfloor x_{\text{i_receive}} \quad y_{\text{i_receive}} \quad z_{\text{i_receive}} \rfloor}{d_{\text{i_receive}}}. \quad \text{Equation (6)}$$

and wherein i={up, down, left, right}

$d_{center_receive}$ is a distance from a center of the phased array to the receiving sensor;

$d_{i_receive}$ is a distance from a vector from the $i^{th}$ signal source to the receiving sensor, and $x_{i_receive}$, $y_{i_receive}$, $z_{i_receive}$ are x, y, and z components of the vector from the $i^{th}$ signal source to the receiving sensor.

Using the foregoing relationships, the gradient ∇M is computed as: ∇M=∇F(:,[1,2,4,5,6]) (all of the rows and the first, second, fourth, fifth, and sixth columns of a sensitivity gradient matrix ∇F ). The use of a subset of the columns of the sensitivity gradient matrix ∇F assures appropriate numerical conditions and that the appropriate parameters can be computed.

Further, the error in the pointing error estimate can be determined as:

$$\begin{bmatrix} E_{\theta_x} \\ E_{\theta_y} \end{bmatrix} = I_{xy}(\nabla M^T \nabla M)^{-1} * (\nabla M^T \nabla N) * \Delta\theta_{\text{array_z}} + I_{xy}(\nabla M^T \nabla M)^{-1} \begin{bmatrix} n_{el} \\ n_{az} \\ n_{\text{d_up}} \\ n_{\text{d_down}} \\ n_{\text{d_left}} \\ n_{\text{d_right}} \end{bmatrix}, \quad \text{Equation (7)}$$

wherein ∇N=∇F(:,3) (all of the rows and the third column of ∇F), $E_{74_x}$ is the error in the pointing error estimate in a first direction, $E_{\Theta_y}$ is an error in the pointing error estimate in a second direction orthogonal to the first direction, $n_{el}$, $n_{az}$, $n_{d_up}$, $n_{d_down}$, $n_{d_left}$, and $n_{d_right}$ represent noise in the measurement of the deviation angles and the distances from the up, down, left and right signal sources 302 to the receiving sensor 114.

The foregoing is ultimately derived from the relationship:

$$\begin{bmatrix} \Delta EZ \\ \Delta AZ \\ \Delta D_{up} \\ \Delta D_{down} \\ \Delta D_{left} \\ \Delta D_{right} \end{bmatrix} = \nabla F * \begin{bmatrix} \Delta\theta_{\text{array_x}} \\ \Delta\theta_{\text{array_y}} \\ \Delta\theta_{\text{array_z}} \\ \Delta x_{\text{array_to_receive}} \\ \Delta y_{\text{array_to_receive}} \\ \Delta z_{\text{array_to_receive}} \end{bmatrix} + \begin{bmatrix} n_{el} \\ n_{az} \\ n_{\text{d_up}} \\ n_{\text{d_down}} \\ n_{\text{d_left}} \\ n_{\text{d_right}} \end{bmatrix} \quad \text{Equation (8)}$$

wherein the terms $\Delta\theta_{array_x}$, $\Delta\theta_{array_y}$, and $\Delta\theta_{array_z}$ represent the angular deformation in spacecraft body frame of the structures supporting the phase array 112 on the spacecraft bus 102 and $\Delta x_{array_to_receive}$. $\Delta y_{array_to_receive}$, and $\Delta z_{array_to_receive}$ represent the translational deformation of the structures supporting the phase array 112 on the spacecraft bus 102.

As shown in FIG. 4, the pointing error determined in block 520 can be added or subtracted from the phased array beam pointing commands, thus compensating for phased array beam pointing errors and increasing the angular accuracy of beams generated by the phased array 112.

Figure 6A:
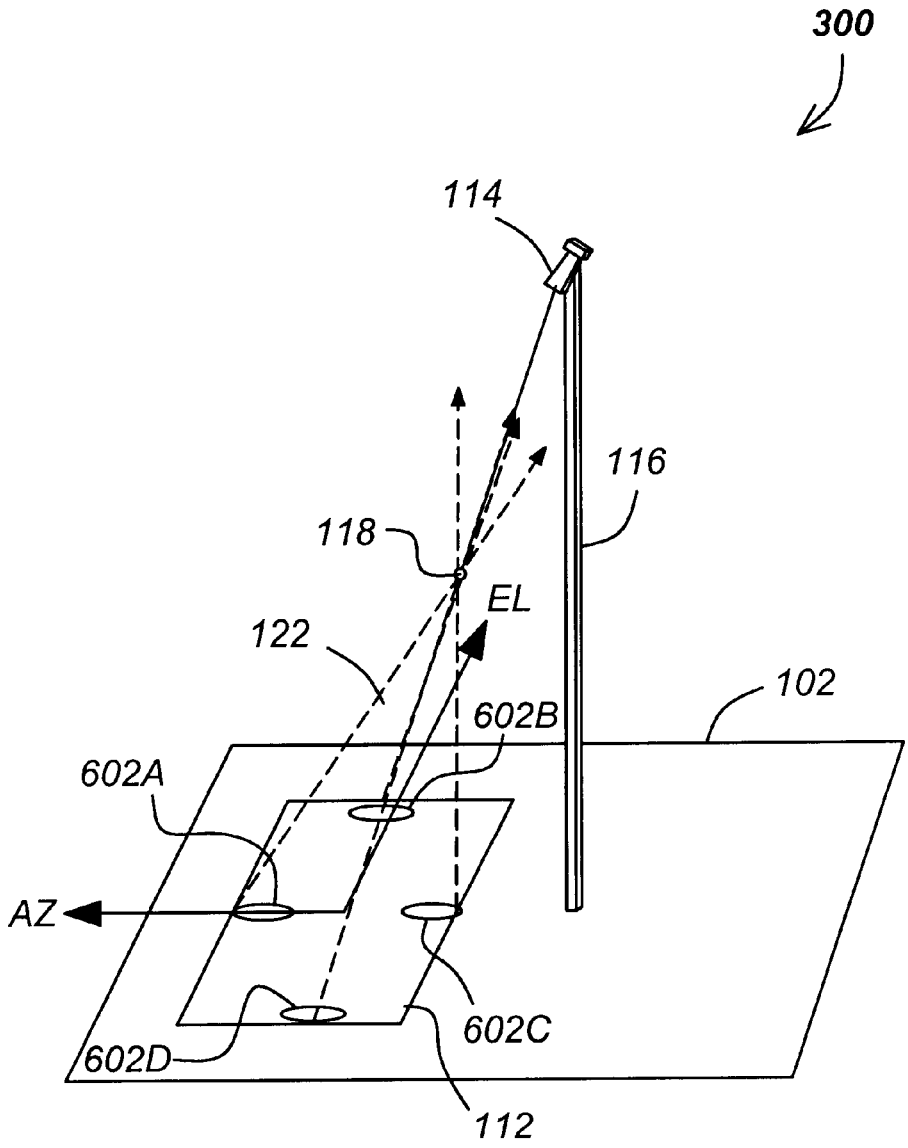
FIGS. 6A and 6B are diagrams depicting further embodiments of the present invention.

FIG. 6A is a diagram of another embodiment of the present invention, in which elements of the phased array 112 itself are used for the signal sources 302 instead of separate RF horns. Such beams can be formed using appropriate portions 602A–602D of the phased array.

Figure 6B:
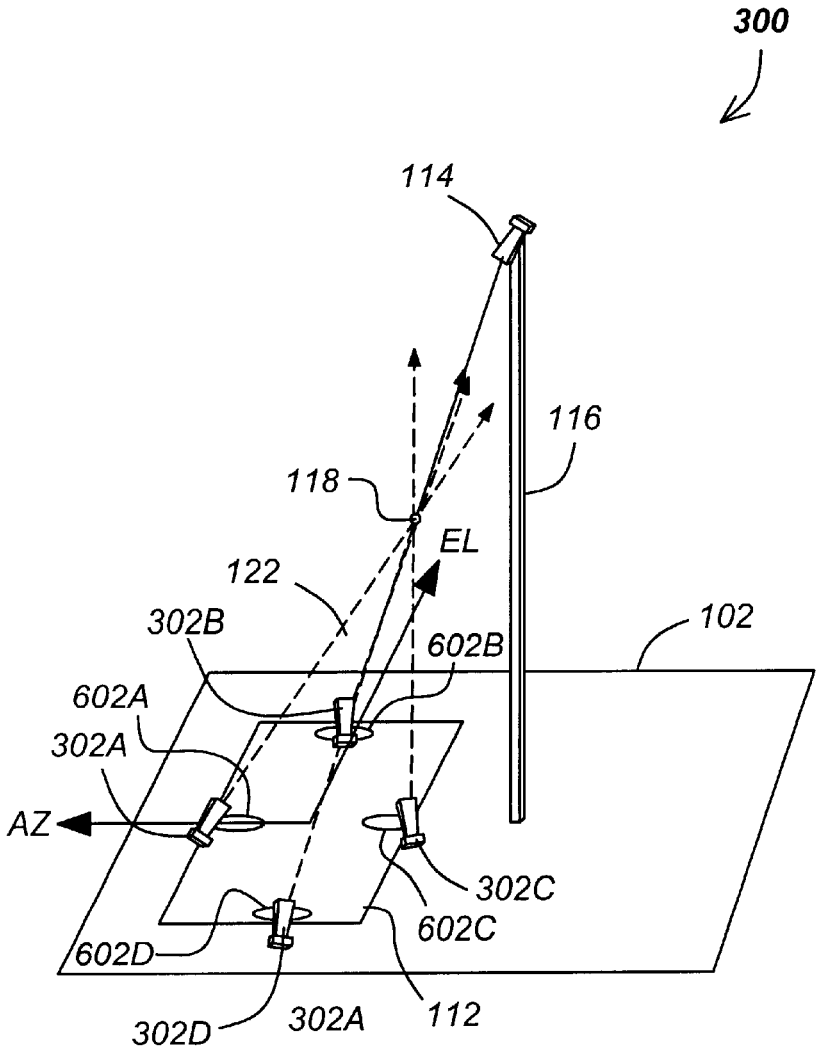

FIG. 6B is a diagram of another embodiment of the present invention, in which signal sources 302A–302D are used to generate signals used to determine the distance from the signal sources 302A–302D to the receiving sensor 114, but in which the portions 602A–602D of the phased array 112 are used to generate signals used to determine azimuth and elevation deviation angles. In this embodiment, the parameters described in Table 1 are represented as described in Tables 2A and 2B below:

TABLE 2A

PHASE ARRAY ELEMENT-FORMED BEAMS

| | LOS Angular Separation from Beacon Null Vector 122 | Beamwidth |
|---|---|---|
| Up Signal Source 602A | $\phi_{EL}$ | $\psi$ |
| Down Signal Source 602C | $-\phi_{EL}$ | $\psi$ |
| Left Signal Source 602D | $\phi_{AZ}$ | $\psi$ |
| Right Signal Source 602B | $-\phi_{AZ}$ | $\psi$ |

TABLE 2B

DISTANCE-MEASUREMENT HORNS

| | Location Separation from Beacon Null Vector 122 |
|---|---|
| Up Signal Source 302A | $d_{AZ}$ |
| Down Signal Source 302C | $-d_{AZ}$ |
| Left Signal Source 302D | $p_{EL}$ |
| Right Signal Source 302B | $-p_{EL}$ |

Although described with respect to a phased array 112 used to transmit signals, the foregoing invention can also be applied to a phased array used to receive signals as well. In this embodiment, a receiving beacon pyramid is formed on the phased array by the signals transmitted to the phased array 112 by a transmitting horn disposed on the boom 116 and nominally along the null vector of the receiving pyramid.

Conclusion

This concludes the description of the preferred embodiments of the present invention. The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto. The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A method of determining a pointing of a phased array, comprising the steps of:

receiving a signal from each of a plurality of signal sources at at least one receiving sensor disposed away from the phased array in a direction at least partially toward a receiver of a transmitted signal from the phased array; and determining the phased array pointing from the received signals.

2. The method of claim 1, wherein the step of determining a phased array pointing from the received signals comprises the steps of:

detecting a magnitude of each of the received signals; and computing an azimuth deviation angle and an elevation deviation angle of from the detected magnitude of each of the received signals.

3. The method of claim 2, wherein:

the plurality of signal sources include an up signal source, a down signal source, a left signal source, and right signal source;

the step of computing an azimuth deviation angle and an elevation deviation angle from the detected magnitude of each of the received signals comprises the step of:

computing the azimuth deviation angle and the elevation deviation angle according to $$EL_{meas} = \alpha \frac{Mag_{up} - Mag_{down}}{Mag_{up} + Mag_{down}},$$

$$AZ_{meas} = \beta \frac{Mag_{left} - Mag_{right}}{Mag_{left} + Mag_{right}}$$

wherein $Mag_{up}$ is a magnitude of the received signal from the up signal source, $Mag_{down}$ is a magnitude of the received signal from the down signal source, $Mag_{left}$ is a magnitude of the received signal from the left signal source, $Mag_{right}$ is a magnitude of the received signal from the right signal source, $\alpha$ is a first scale factor, and $\beta$ is a second scale factor.

4. The method of claim 2, wherein the step of determining a phased array pointing correction from the received signals further comprises the steps of:

detecting a phase of each of the received signals; and computing a distance between each of the signal sources and the receiving sensor from the detected phase of each of the received signals.

5. The method of claim 4, wherein:

the step of computing a distance between the each of the plurality of signal sources and the receiving sensor from the detected phase of each of the received signals comprises the step of:

computing the distance for each of the horns according to $$D_{up} = \frac{phase_{up}}{2\pi}\lambda_{up},$$

$$D_{down} = \frac{phase_{down}}{2\pi}\lambda_{down},$$

$$D_{left} = \frac{phase_{left}}{2\pi}\lambda_{left}, \text{ and}$$

-continued $$D_{right} = \frac{phase_{right}}{2\pi}\lambda_{right},$$

wherein $D_{up}$, $D_{down}$, $D_{left}$, and $D_{right}$ are measured distances from an up, down, left, and right signal source to the receiving sensor, respectively, and $\lambda$ is a wavelength of the received signal.

6. The method of claim 5, further comprising the steps of computing an array pointing correction.

7. The method of claim 6, wherein the step of computing an array pointing correction comprises the steps of:

determining an array pointing error according to the relation:

$$\begin{bmatrix} \Delta\theta_{\text{array_x}} \\ \Delta\theta_{\text{array_y}} \end{bmatrix} = I_{xy}(\nabla M^T \nabla M)^{-1} \nabla M^T * \begin{bmatrix} \Delta EL \\ \Delta AZ \\ \Delta D_{up} \\ \Delta D_{down} \\ \Delta D_{left} \\ \Delta D_{right} \end{bmatrix},$$

$$I_{xy} = \begin{bmatrix} 1 & 0 & 0 & 0 & 0 & 0 \\ 0 & 1 & 0 & 0 & 0 & 0 \end{bmatrix}$$

wherein:

$\nabla$M is all of the rows and a first, second, fourth, fifth, and sixth columns of a sensitivity gradient matrix $\nabla$F;

$$\Delta EL = EL_{meas} - EL_0$$

$$\Delta AZ = AZ_{meas} - AZ_0$$

$$\Delta D_{up} = D_{up} - D_{up_0}$$

$$\Delta D_{down} = D_{down} - D_{down_0}$$

$$\Delta D_{left} = D_{left} - D_{left_0}$$

$$\Delta D_{right} = D_{right} - D_{right_0}$$

and wherein $\nabla$F is defined as:

$$\nabla F = \begin{bmatrix} I_{EL} & T_{\text{center_receive_EL}} \\ I_{AZ} & T_{\text{center_receive_AZ}} \\ v_{\text{up_receive}} S_{\text{up_center}} & v_{\text{up_receive}} \\ v_{\text{down_receive}} S_{\text{down_center}} & v_{\text{down_receive}} \\ v_{\text{left_receive}} S_{\text{left_center}} & v_{\text{left_receive}} \\ v_{\text{right_receive}} S_{\text{right_center}} & v_{\text{right_receive}} \end{bmatrix} \begin{bmatrix} C_{\text{Null_SC}} & 0 \\ 0 & C_{\text{Null_SC}} \end{bmatrix}$$

wherein:

$$I_{EL} = [100],$$

$$I_{AZ} = [010],$$

$C_{Null_SC}$ is a direction matrix describing a transformation from a spacecraft inertial reference frame to a null vector reference frame;

$S_{up_center}$ is a skew symmetric position vector matrix describing a vector from a center of the phase array to the up signal source;

$S_{down_center}$ is a skew symmetric position vector matrix describing a vector from the center of the phase array to the down signal source;

$S_{left_center}$ is a skew symmetric position vector matrix describing a vector from the center of the phase array to the left signal source;

$S_{right_center}$ is a skew symmetric position vector matrix describing a vector from the center of the phase array to the right signal source;

$$T_{\text{center_receive_EL}} = \begin{bmatrix} 0 & \frac{1}{d_{\text{center_receive}}} & 0 \end{bmatrix}, \text{ and}$$

$$T_{\text{center_receive_AZ}} = \begin{bmatrix} \frac{1}{d_{\text{center_receive}}} & 0 & 0 \end{bmatrix}, \text{ and}$$

$$v_i = \frac{\lfloor x_{\text{i_receive}} \quad y_{\text{i_receive}} \quad z_{\text{i_receive}} \rfloor}{d_{\text{i_receive}}}$$

wherein i={up, down, left and right}

$d_{center_receive}$ is a distance from a center of the phased array to the receiving sensor; $d_{i_receive}$ is a distance from a vector from the $i^{th}$ signal source to the receiving sensor; and $x_{i_receive}$, $y_{i_receive}$, $z_{i_receive}$ are x, y, and z components of the vector from the $i^{th}$ signal source to the receiving sensor.

8. The method of claim 1, wherein the plurality of signal sources are disposed adjacent the phased array.

9. The method of claim 1, wherein the plurality of signal sources are implemented in different regions of the phased array.

10. The method of claim 1, wherein the plurality of signal sources includes at least three signal sources.

11. The method of claim 1, wherein the plurality of signal sources are disposed at a periphery of the phased array.

12. The method of claim 1, wherein the plurality of signal sources are distinguished according to a parameter selected from the group comprising time, frequency, and code.

13. An apparatus for determining a pointing of a phased array, comprising:

a receiving sensor, for receiving a signal from each of a plurality of signal sources, the receiving sensor disposed away from the phased array in a direction at least partially toward a receiver of a transmitted signal from the phased array; and an array pointing computer for determining the direction of the phased array from the received signals.

14. The apparatus of claim 13, wherein array pointing computer comprises:

a signal magnitude computer for determining a magnitude of each of the received signals; and a deviation angle computer for determining an azimuth deviation angle and an elevation deviation angle of from the detected magnitude of each of the received signals.

15. The apparatus of claim 14, wherein:

the plurality of signal sources include an up signal source, a down signal source, a left signal source, and right signal source;

the deviation angle computer determines the azimuth deviation angle and the elevation deviation angle from the detected magnitude of each of the received signals according to $$EL_{meas} = \alpha \frac{Mag_{up} - Mag_{down}}{Mag_{up} + Mag_{down}},$$

$$AZ_{meas} = \beta \frac{Mag_{left} - Mag_{right}}{Mag_{left} + Mag_{right}}$$

wherein $Mag_{up}$ is a magnitude of the received signal from the up signal source, $Mag_{down}$ is a magnitude of the received signal from the down signal source, $Mag_{left}$ is a magnitude of the received signal from the left signal source, $Mag_{right}$ is a magnitude of the received signal from the right signal source, $\alpha$ is a first scale factor, and $\beta$ is a second scale factor.

16. The apparatus of claim 14, wherein the array pointing computer further comprises:

a phase detector communicatively coupled to the receiving sensor, the phase detector determining a phase of each of the received signals; and a distance computer for generating a distance between each of the signal sources and the receiving sensor from the detected phase of each of the received signals.

17. The apparatus of claim 16, wherein:

the distance computer computes the distance between the signal sources and the receiving sensor from the detected phase of the received signals according to $$D_{up} = \frac{phase_{up}}{2\pi}\lambda_{up},$$

$$D_{down} = \frac{phase_{down}}{2\pi}\lambda_{down},$$

$$D_{left} = \frac{phase_{left}}{2\pi}\lambda_{left},$$

and $$D_{right} = \frac{phase_{right}}{2\pi}\lambda_{right},$$

wherein $D_{up}$, $D_{down}$, $D_{left}$, and $D_{right}$ are measured distances from an up, down, left, and right signal source to the receiving sensor, respectively, and $\lambda$ is a wave length of the Received signal.

18. The apparatus of claim 17, wherein the array pointing computer further comprises an array pointing correction computer for computing an array pointing correction.

19. The apparatus of claim 18, array pointing error computer determines the array pointing correction according to the relation:

$$\begin{bmatrix} \Delta\theta_{\text{array_x}} \\ \Delta\theta_{\text{array_y}} \end{bmatrix} = I_{xy}(\nabla M^T \nabla M)^{-1} \nabla M^T * \begin{bmatrix} \Delta EL \\ \Delta AZ \\ \Delta D_{up} \\ \Delta D_{down} \\ \Delta D_{left} \\ \Delta D_{right} \end{bmatrix},$$

$$I_{xy} = \begin{bmatrix} 1 & 0 & 0 & 0 & 0 & 0 \\ 0 & 1 & 0 & 0 & 0 & 0 \end{bmatrix}$$

wherein:

$\nabla M$ is all of the rows and a first, second, fourth, fifth, and sixth columns of a sensitivity gradient matrix $\nabla F$;

$$\Delta EL = EL_{meas} - EL_0$$

$$\Delta AZ = AZ_{meas} - AZ_0$$

$$\Delta D_{up} = D_{up} - D_{up_0}$$

$$\Delta D_{down} = D_{down} - D_{down_0}$$

$$\Delta D_{left} = D_{left} - D_{left_0}$$

$$\Delta D_{right} = D_{right} - D_{right_0}$$

and wherein $\nabla F$ is defined as:

$$\nabla F = \begin{bmatrix} I_{EL} & T_{\text{center_receive_EL}} \\ I_{AZ} & T_{\text{center_receive_AZ}} \\ v_{\text{up_receive}} S_{\text{up_center}} & v_{\text{up_receive}} \\ v_{\text{down_receive}} S_{\text{down_center}} & v_{\text{down_receive}} \\ v_{\text{left_receive}} S_{\text{left_center}} & v_{\text{left_receive}} \\ v_{\text{right_receive}} S_{\text{right_center}} & v_{\text{right_receive}} \end{bmatrix} \begin{bmatrix} C_{\text{Null_SC}} & 0 \\ 0 & C_{\text{Null_SC}} \end{bmatrix}$$

wherein:

$$I_{EL} = [100],$$

$$I_{AZ} = [010],$$

$C_{Null_SC}$ is a direction matrix describing a transformation from a spacecraft inertial reference frame to a null vector reference frame;

$S_{up_center}$ is a skew symmetric position vector matrix from the center of the array to the up horn;

$S_{down_center}$ is a skew symmetric position vector matrix from the center of the array to the down horn;

$S_{left_center}$ is a skew symmetric position vector matrix from the center of the array to the left horn;

$S_{right_center}$ is a skew symmetric position vector matrix from the center of the array to the right horn;

$$T_{\text{center_receive_EL}} = \begin{bmatrix} 0 & \frac{1}{d_{\text{center_receive}}} & 0 \end{bmatrix}, \text{ and}$$

$$T_{\text{center_receive_AZ}} = \begin{bmatrix} \frac{1}{d_{\text{center_receive}}} & 0 & 0 \end{bmatrix}, \text{ and}$$

$$v_i = \frac{\lfloor x_{\text{i_receive}} \quad y_{\text{i_receive}} \quad z_{\text{i_receive}} \rfloor}{d_{\text{i_receive}}}$$

wherein i={up, down, left, and right}

$d_{center_receive}$ is a distance from a center of the phased array to the receiving sensor; $d_{i_receive}$ is a distance from a vector from the $i^{th}$ signal source to the receiving sensor; and $x_{i_receive}$, $y_{i_receive}$, $z_{i_receive}$ are x, y, and z components of the vector from the $i^{th}$ signal source to the receiving sensor.

20. The apparatus of claim 13, wherein the plurality of signal sources are disposed adjacent the phased array.

21. The apparatus of claim 13, wherein the plurality of signal sources are implemented in different regions of the phased array.

22. The apparatus of claim 13, wherein the plurality of signal sources includes at least three signal sources.

23. The apparatus of claim 13, wherein the plurality of signal sources are disposed at a periphery of the phased array.

24. The apparatus of claim 13, wherein the plurality of signal sources are distinguished according to a parameter selected from the group comprising time, frequency, and code.

25. An apparatus for determining a pointing of a phased array, comprising the steps of:

means for receiving a signal from each of a plurality of signal sources at at least one receiving sensor disposed away from the phased array in a direction at least partially toward a receiver of a transmitted signal from the phased array; and means for determining the phased array pointing from the received signals.

26. The apparatus of claim 25, wherein the means for determining a phased array pointing from the received signals comprises:

means for detecting a magnitude of each of the received signals; and means for computing an azimuth deviation angle and an elevation deviation angle of from the detected magnitude of each of the received signals.

27. The apparatus of claim 26, wherein:

the plurality of signal sources include an up signal source, a down signal source, a left signal source, and right signal source;

the means for computing an azimuth deviation angle and an elevation deviation angle from the detected magnitude of each of the received signals comprises:

means for computing the azimuth deviation angle and the elevation deviation angle according to $$EL_{meas} = \alpha \frac{Mag_{up} - Mag_{down}}{Mag_{up} + Mag_{down}},$$

$$AZ_{meas} = \beta \frac{Mag_{left} - Mag_{right}}{Mag_{left} + Mag_{right}}$$

wherein $Mag_{up}$ is a magnitude of the received signal from the up signal source, $Mag_{down}$ is a magnitude of the received signal from the down signal source, $Mag_{left}$ is a magnitude of the received signal from the left signal source, $Mag_{right}$ is a magnitude of the received signal from the right signal source, $\alpha$ is a first scale factor, and $\beta$ is a second scale factor.

28. The apparatus of claim 26, wherein the means for determining a phased array pointing correction from the received signals further comprises:

means for detecting a phase of each of the received signals; and means for computing a distance between each of the signal sources, and the receiving sensor from the detected phase of each of the received signals.

29. The apparatus of claim 28, wherein:

the means for computing a distance between the each of the plurality of signal sources and the receiving sensor from the detected phase of each of the received signals comprises:

means for computing the distance for each of the horns according to $$D_{up} = \frac{phase_{up}}{2\pi}\lambda_{up},$$

-continued $$D_{down} = \frac{phase_{down}}{2\pi}\lambda_{down},$$

$$D_{left} = \frac{phase_{left}}{2\pi}\lambda_{left},$$

and $$D_{right} = \frac{phase_{right}}{2\pi}\lambda_{right},$$

wherein $D_{up}$, $D_{down}$, $D_{left}$, and $D_{right}$ are measured distances from an up, down, left, and right signal source to the receiving sensor, respectively, $\lambda$ is a wave length of the received signal.

30. The apparatus of claim 29, further comprising means for computing an array pointing correction.

31. The apparatus of claim 30, wherein the means for computing an array pointing correction comprises:

means for determining an array pointing error according to the relation:

$$\begin{bmatrix} \Delta\theta_{\text{array_x}} \\ \Delta\theta_{\text{array_y}} \end{bmatrix} = I_{xy}(\nabla M^T \nabla M)^{-1} \nabla M^T * \begin{bmatrix} \Delta EL \\ \Delta AZ \\ \Delta D_{up} \\ \Delta D_{down} \\ \Delta D_{left} \\ \Delta D_{right} \end{bmatrix},$$

$$I_{xy} = \begin{bmatrix} 1 & 0 & 0 & 0 & 0 & 0 \\ 0 & 1 & 0 & 0 & 0 & 0 \end{bmatrix}$$

wherein:

$\nabla M = \nabla F(:,[1,2,4,5,6])$ (all of the rows and the first, second, fourth, fifth, and sixth columns of a sensitivity gradient matrix $\nabla F$);

$$\Delta EL = EL_{meas} - EL_0$$

$$\Delta AZ = AZ_{meas} - AZ_0$$

$$\Delta D_{up} = D_{up} - D_{up_0}$$

$$\Delta D_{down} = D_{down} - D_{down_0}$$

$$\Delta D_{left} = D_{left} - D_{left_0}$$

$$\Delta D_{right} = D_{right} - D_{right_0}$$

and wherein $\nabla F$ is defined as:

$$\nabla F = \begin{bmatrix} I_{EL} & T_{\text{center_receive_EL}} \\ I_{AZ} & T_{\text{center_receive_AZ}} \\ v_{\text{up_receive}} S_{\text{up_center}} & v_{\text{up_receive}} \\ v_{\text{down_receive}} S_{\text{down_center}} & v_{\text{down_receive}} \\ v_{\text{left_receive}} S_{\text{left_center}} & v_{\text{left_receive}} \\ v_{\text{right_receive}} S_{\text{right_center}} & v_{\text{right_receive}} \end{bmatrix} \begin{bmatrix} C_{\text{Null_SC}} & 0 \\ 0 & C_{\text{Null_SC}} \end{bmatrix}$$

wherein:

$$I_{EL} = [100],$$

$$I_{AZ} = [010],$$

$C_{Null_SC}$ is a direction matrix describing a transformation from a spacecraft inertial reference frame to a null vector reference frame;

$S_{up_center}$ is a skew symmetric position vector matrix from the center of the array to the up horn;

$S_{down_center}$ is a skew symmetric position vector matrix from the center of the array to the down horn;

$S_{left_center}$ is a skew symmetric position vector matrix from the center of the array to the left horn;

$S_{right_center}$ is a skew symmetric position vector matrix from the center of the array to the right horn;

$$T_{\text{center_receive_EL}} = \begin{bmatrix} 0 & \frac{1}{d_{\text{center_receive}}} & 0 \end{bmatrix}, \text{ and}$$

$$T_{\text{center_receive_AZ}} = \begin{bmatrix} \frac{1}{d_{\text{center_receive}}} & 0 & 0 \end{bmatrix}, \text{ and}$$

$$v_i = \frac{\lfloor x_{\text{i_receive}} \quad y_{\text{i_receive}} \quad z_{\text{i_receive}} \rfloor}{d_{\text{i_receive}}}$$

wherein i={up, down, left, and right}

$d_{center_receive}$ is a distance from a center of the phased array to the receiving sensor, $d_{i_receive}$ is a distance from a vector from the $i^{th}$ signal source to the receiving sensor, and $x_{i_receive}$, $y_{i_receive}$, $z_{i_receive}$ are x, y and z components of the vector from the $i^{th}$ signal source to the receiving sensor.

32. The apparatus of claim 25, wherein the plurality of signal sources are disposed adjacent the phased array.

33. The apparatus of claim 25, wherein the plurality of signal sources are implemented in different regions of the phased array.

34. The apparatus of claim 25, wherein the plurality of signal sources includes at least three signal sources.

35. The apparatus of claim 25, wherein the plurality of signal sources are disposed at a periphery of the phased array.

36. The apparatus of claim 25, wherein the plurality of signal sources are distinguished according to a parameter selected from the group comprising time, frequency, and code.

* * * * *